US005476697A

United States Patent [19]

Bellander

[11] Patent Number: 5,476,697

[45] Date of Patent: Dec. 19, 1995

[54] PAPER NAPKIN WITH SELF-ADHESIVE PORTIONS

[76] Inventor: Wanja Bellander, Toravägen Herrviksnäs, S-139 00 Värmdö , Sweden

[21] Appl. No.: 90,114

[22] PCT Filed: Jan. 21, 1992

[86] PCT No.: PCT/SE92/00037

§ 371 Date: Jul. 20, 1993

§ 102(e) Date: Jul. 20, 1993

[87] PCT Pub. No.: WO92/13040

PCT Pub. Date: Aug. 6, 1992

[30] Foreign Application Priority Data

Jan. 21, 1991 [SE] Sweden ..... 9100171

[51] Int. Cl.[6] ..... A47G 11/00; C09J 7/04

[52] U.S. Cl. ..... 428/40; 2/49.3; 2/49.4; 2/49.5; 24/7; 24/8; 24/9; 428/121; 428/124; 428/192; 428/194; 428/195; 428/201; 428/202; 428/211; 428/354; 428/355

[58] Field of Search ..... 428/40, 121, 343, 428/354, 355, 194, 124, 192, 81, 84, 537.5, 195, 201, 202, 211; 427/285, 288; 2/49.1, 49.2, 49.3, 49.4, 136, 49.5, 46; 24/7, 8, 9; D6/595

[56] References Cited

U.S. PATENT DOCUMENTS

| | | | |
|---|---|---|---|
| 1,942,287 | 1/1934 | Heitz | 428/192 |
| 2,145,139 | 1/1939 | Scharfenberg | 2/46 |
| 2,803,574 | 8/1957 | Payant | 24/7 |
| 3,398,438 | 8/1968 | Fried | 24/7 |
| 4,460,634 | 7/1984 | Hasegawa | 428/124 |
| 4,815,457 | 3/1989 | Mazars et al. | 128/155 |
| 4,995,641 | 2/1991 | Landry | 428/40 |
| 5,194,299 | 3/1993 | Fry | 428/194 |

FOREIGN PATENT DOCUMENTS

| | | | |
|---|---|---|---|
| 3207883 | 9/1983 | Germany | 2/49.1 |
| 8400363 | 7/1985 | Sweden . | |
| 2110073 | 6/1983 | United Kingdom . | |
| 8706105 | 10/1987 | WIPO | 2/49.2 |
| WO87/07971 | 12/1987 | WIPO . | |

*Primary Examiner*—Nasser Ahmad

*Attorney, Agent, or Firm*—Frishauf, Holtz, Goodman, Langer & Chick

[57] ABSTRACT

A paper napkin or similar sheet formed object which is intended to be attached to an article of clothing to protect it from spillage, comprises a sheet with reinforcement areas on surface portions thereof. The napkin sheet is folded before usage such that adhesive surfaces (3) on the reinforcement areas (1) are in close contact with adhesive or non-adhesive parts of the reinforcement areas which parts in this position form a protection for the adhesive surfaces (3) of the sheet.

12 Claims, 1 Drawing Sheet

PAPER NAPKIN WITH SELF-ADHESIVE PORTIONS

BACKGROUND OF THE INVENTION

The present invention relates to a paper napkin with self-adhesive portions of the type having adhesive thereon for securement to an article of clothing of a user to protect the user's clothing from spillage.

Paper napkins are known, which are provided with at least one limited surface coated with an adhesive layer, and wherein before usage, the adhesive layer is protected by a removable paper slip or peel off label. Such a removable paper slip will most likely end up on the floor, and if this type of napkin is used by many people in a room, the room will be very littered with all the removable paper slips on the floor.

If the napkin is provided with two such limited adhesive coated surfaces with a protective paper slip on each, there will not be only twice as much litter but also it will be more complicated to handle the napkin while removing the paper slips with change of grip and with the risk that the adhesive surfaces will stick somewhere in an uncontrollable way.

OBJECT AND SUMMARY OF THE INVENTION

The object of the invention is to provide a napkin where the aforementioned inconveniences are eliminated.

According to the present invention, a paper napkin for protecting an article of clothing from spillage comprises a paper napkin sheet comprising a liquid-absorbing material having poor mechanical strength properties; at least two reinforcement areas on the paper napkin sheet; and at least one adhesive surface portion on the sheet, the at least one adhesive surface portion being substantially smaller than the sheet, and the at least one adhesive surface portion comprising a permanent adhesive layer. The paper napkin sheet is folded before usage so that the at least one adhesive surface portion is in close contact with another part of the paper napkin sheet, so that when the paper napkin sheet is in the folded position, the another part of the paper napkin sheet serves as are movable cover surface for the adhesive layer of the at least one adhesive surface portion. The at least one adhesive surface portion and the removable cover surface each are arranged on a respective reinforcement area of the paper napkin sheet, the reinforcement areas each extending outside of the respective adhesive surface portion and the removable cover surface, and the reinforcement areas serving as respective grip surfaces for removing the at least one adhesive surface portion from the removable cover surface which covers the adhesive surface portion.

By virtue of the invention, the use of loose paper slips or peel off labels as protection for the adhesive surfaces has been made unnecessary. Also the handling of the napkin has been made easier. If the napkin is provided with adhesive layers in at least two corners of the unfolded napkin, the unfolding of the napkin is accomplished at the same time as the corners are drawn apart, and without changing the grip on the napkin, the corners of the napkin can be pressed on the intended article of clothing, for example a shirt or a blouse.

The paper napkin is often made of a liquid-absorbing material with very poor mechanical strength properties. Thus, according to a preferred embodiment of the invention, the napkin is provided with reinforcement areas.

DETAILED DESCRIPTION

Figure 1:
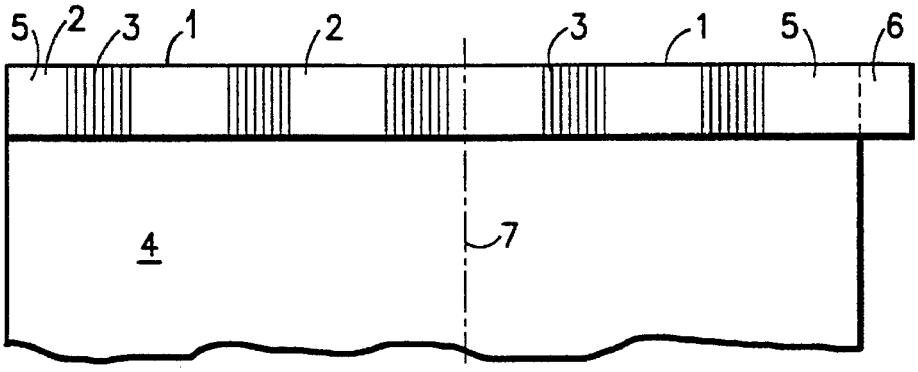
FIG. 1 shows a part of a napkin sheet fabricated in accordance with the present invention.

FIG. 1 shows a part of a napkin sheet 4 with a reinforcement area i along an edge portion of the napkin. The reinforcement area 1 has non-adhesive parts 2 and limited area adhesive parts 3. The reinforcement area 1 can be achieved in many ways, for example with pressure, heat treatment and/or chemical treatment of a sheet 4 of a web of material with appropriate properties. The sheet 4 can alternatively be provided with a reinforcement area in the shape of a strip of tear-resistent paper or plastic. The farthest out reinforcement areas at the outermost portions of the napkin are non-adhesive to form grip surfaces 5, and one grip surface 5 is arranged to project out outside the edge of the napkin by a short distance to form a pull flap 6. The adhesive surfaces 3 are positioned so that when folding the napkin along a folding line 7, the adhesive surfaces 3 on one half portion of the reinforcement area 1 will be positioned on the non-adhesive surfaces 2 on the other half portion, and vice versa. With this arrangement, it will be easier to draw apart the halves than if the adhesive surfaces 3 on the two halves would be positioned opposite each other. In the case where the adhesive surfaces 3 are positioned to be over the non-adhesive surfaces 2 when the napkin is folded, the reinforcement area 1 can possibly be eliminated and the adhesive surfaces 3 can be arranged to contact directly on the sheet 4.

Figure 2:
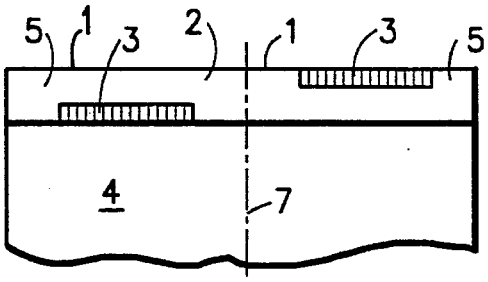
FIG. 2 shows a part of a napkin sheet of the present invention according to a modified embodiment, and on a reduced scale.
Figure 3:
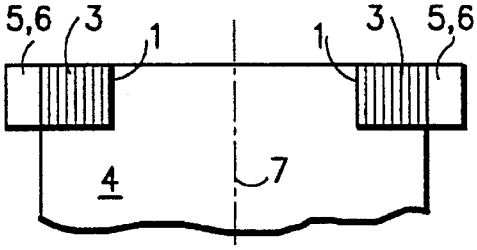
FIG. 3 shows a part of a napkin sheet of the present invention according to another modified embodiment, and on a reduced scale.

FIG. 2 shows an alternative design with the adhesive surfaces 3 vertically displaced. FIG. 3 shows a design with the reinforcement areas 1 positioned at both upper corner parts of the napkin and sticking out unequally laterally, to form grip surfaces 5 and at the same time to form pull flaps 6, with the adhesive surfaces 3 extending to the grip surfaces 5.

Figure 4:
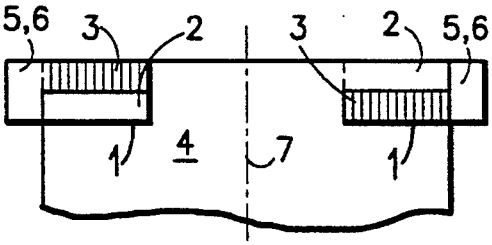
FIG. 4 shows a part of a napkin sheet of the present invention according to another modified embodiment, and on a reduced scale.

With a design according to FIG. 4 which is similar to the one in FIG. 3, the adhesive surfaces 3 are vertically reduced to half the height as those of FIG. 3, and are mutually, vertically displaced. Non-adhesive surfaces 2 are provided above and below the respective adhesive surfaces 3 in FIG. 4.

Figure 5:
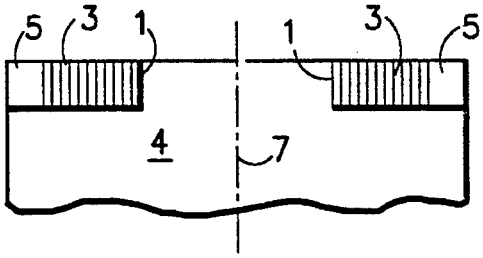
FIG. 5 shows a part of a napkin sheet of the present invention according to another modified embodiment, and on a reduced scale.
Figure 6:
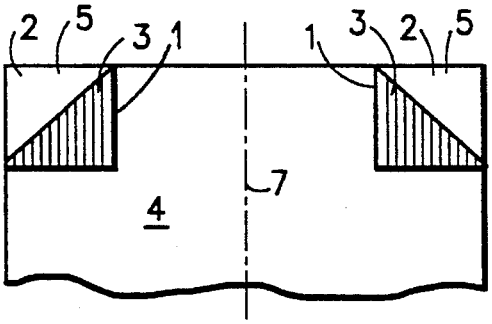
FIG. 6 shows a part of a napkin sheet of the present invention according to another modified embodiment, and on a reduced scale.

FIG. 5 shows a design similar to the one according to FIG. 3, but instead of having the reinforcement areas 1 arranged to project and serve as pull flaps 6, non-adhesive surfaces are arranged farthest out in the corners so as to serve as grip surfaces 5. FIG. 6 shows a modified design of the one shown in FIG. 5.

Figure 7:
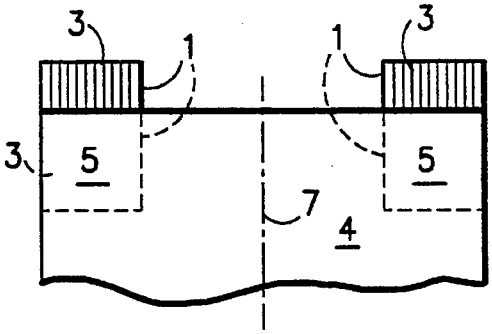
FIG. 7 shows a part of a napkin sheet of the present invention according to another modified embodiment, and on a reduced scale.

FIGS. 1–6 show designs where the adhesive surfaces 3 are positioned on the front side of the sheet 4 shown on the drawing. These adhesive surfaces 3 must be affixed before the sheets 4 are folded up along the line 7. A simpler manufacturing process can be obtained if the sheets 4 first can be folded along the line 7 and after that be equipped with reinforcement strips 1 on the outside. The outside reinforcement strips are provided with vertically and/or laterally protruding adhesive surfaces 3. Such a design, with vertically protruding adhesive surfaces 3, is shown unfolded in FIG. 7. The entire surface of each reinforcement strip 1 in FIG. 7 is provided with an adhesive layer, the lower adhesive parts to stick to the back of the folded sheet 4 and the upper adhesive parts to stick to each other when the halves of the sheet 4 are folded together about the fold line. The adhesive surfaces 3 can, of course, as shown earlier, be mutually displaced, so as not to stick to each other and so that the adhesive surfaces can be more easily drawn apart with the lower parts of the reinforcement strips forming very good grip surfaces 5.

The adhesives used are of the kind that do not become inactive but remain permanently active, and the adhesive capacity is adjusted depending on the strength properties of the napkins. An example of a usable adhesive is the kind used for note pads of the type called Post-it (reg. trademark) which is a repositionable adhesive, wherein the note pad sheets can be temporarily adhered, removed and repositioned. For stronger adhesive capacity the adhesive used for self-adhesive tape can be used. However, the adhesive surfaces of self-adhesive tape should not be in contact with each other, since the adhesiveness in that case might be too strong and separation would be difficult.

I claim:

1. A folded paper napkin for protecting an article of clothing from spillage, said paper napkin comprising:

a paper napkin sheet (4) comprising a liquid-absorbing material having poor mechanical strength properties;

at least two spaced apart reinforcement areas (1) at respective predetermined spaced apart positions on said paper napkin sheet (4);

at least one adhesive surface portion (3) on said reinforcement areas (1), said at least one adhesive surface portion (3) being substantially smaller than said reinforcement areas (1), and said at least one adhesive surface portion (3) comprising a layer of a repositionable adhesive thereon for permitting adhering, removal and repositioning of the at least one adhesive surface portion (3) relative to a surface on which said adhesive is contacted;

said paper napkin sheet (4) being folded before usage so that said at least one adhesive surface portion (3) is in contact with an opposite part (2) of said reinforcement areas (1), so that with said paper napkin sheet being in a folded position, said opposite part (2) of said reinforcement areas (1) serves as a removable cover surface (2) for said layer of said adhesive of said at least one adhesive surface portion (3);

said at least one adhesive surface portion (3) and said removable cover surface (2) each being arranged on a respective reinforcement area (1) of said paper napkin sheet (4), said reinforcement areas (1) each protruding outside of said respective adhesive surface portion (3) and said removable cover surface (2), and said protruding reinforcement areas (1) serving as respective grip surfaces (5) for removing said at least one adhesive surface portion (3) from the removable cover surface (2) which covers said adhesive surface portion.

2. The paper napkin of claim 1, wherein said removable cover surface (2) comprises a layer of said adhesive on a surface thereof which faces said layer of adhesive of said at least one adhesive surface portion (3) thereon.

3. The paper napkin of claim 2, wherein said reinforcement areas (1) each comprise a reinforcement strip of tear-resistant material (1) that is fixedly joined with said paper napkin sheet (4).

4. The paper napkin of claim 3, wherein said tear-resistant material is paper.

5. The paper napkin of claim 1, wherein said reinforcement areas (1) each comprise a reinforcement strip of tear-resistant material (1) that is fixedly joined with said paper napkin sheet (4).

6. The paper napkin of claim 1, wherein said tear-resistant material is paper.

7. The paper napkin according to claim 5, wherein said reinforcement strips of tear-resistant material (1) are elongated and are fastened on the outside of two adjacent parts (4) of the folded napkin with parts of said reinforcement strips (1) protruding transversely and opposite each other and outside of respective edges of said paper napkin sheet with said layers of said adhesive means facing each other.

8. The paper napkin of claim 7, wherein said layers of said adhesive means on said adhesive surface portions (3) and on said removable cover surface (2) are offset with respect to each other when the paper napkin sheet (4) is in the folded position.

9. The paper napkin of claim 1, wherein said layers of said adhesive on said adhesive surface portions (3) and on said removable cover surface (2) are offset with respect to each other when the paper napkin sheet (4) is in the folded position.

10. The paper napkin of claim 2, wherein said layers of said adhesive on said adhesive surface portions (3) and on said removable cover surface (2) are offset with respect to each other when the paper napkin sheet (4) is in the folded position.

11. The paper napkin of claim 3, wherein said layers of said adhesive on said adhesive surface portions (3) and on said removable cover surface (2) are offset with respect to each other when the paper napkin sheet (4) is in the folded position.

12. The paper napkin of claim 5, wherein said layers of said adhesive means on said adhesive surface portions (3) and on said removable cover surface (2) are offset with respect to each other when the paper napkin sheet (4) is in the folded position.

* * * * *